US010151202B2

(12) United States Patent
Faulkner et al.

(10) Patent No.: US 10,151,202 B2
(45) Date of Patent: Dec. 11, 2018

(54) RIB STRAP

(71) Applicant: FCI Holdings Delaware, Inc., Wilmington, DE (US)

(72) Inventors: Dakota Faulkner, New Kensington, PA (US); John C. Stankus, Canonsburg, PA (US); Travis Mikel Sub, Butler, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 15/042,937

(22) Filed: Feb. 12, 2016

(65) Prior Publication Data

US 2016/0237819 A1 Aug. 18, 2016

Related U.S. Application Data

(60) Provisional application No. 62/116,045, filed on Feb. 13, 2015.

(51) Int. Cl.
*E21D 21/00* (2006.01)
*E21D 11/00* (2006.01)

(52) U.S. Cl.
CPC ..... *E21D 21/0086* (2013.01); *E21D 11/006* (2013.01); *E21D 21/0006* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,775,266 | A * | 10/1988 | Seegmiller | E21D 11/006 405/259.1 |
| 5,489,176 | A * | 2/1996 | Fultz | B23P 19/062 29/432.2 |
| 5,769,570 | A | 6/1998 | Stankus et al. | |
| 6,146,056 | A | 11/2000 | Calandra, Jr. | |
| 7,284,933 | B2 | 10/2007 | Calandra, Jr. et al. | |
| 7,794,181 | B2 | 9/2010 | Hendrick | |
| D628,047 | S | 11/2010 | Craig | |
| 8,052,353 | B2 | 11/2011 | Oldsen et al. | |
| 8,197,160 | B2 | 6/2012 | Stankus et al. | |
| 8,596,923 | B2 | 12/2013 | Oldsen et al. | |
| 2005/0031420 | A1* | 2/2005 | Domanski | E21D 11/107 405/288 |
| 2011/0052334 | A1* | 3/2011 | Breedlove | E21D 15/14 405/290 |
| 2013/0236250 | A1 | 9/2013 | Sub et al. | |

* cited by examiner

*Primary Examiner* — Kyle Armstrong
(74) *Attorney, Agent, or Firm* — The Webb Law Firm

(57) ABSTRACT

A mine rib support includes first and second elongate members each having a first end and a second end, a center plate having a body defining a first opening that receives the first elongate member, a second opening that receives the second elongate member, and an installation opening configured to receive a mine bolt, a first end plate defining first and second openings for receiving the first end of the first and second elongate members, respectively, and a second end plate defining first and second openings for receiving the second end of the first and second elongate members, respectively.

7 Claims, 8 Drawing Sheets

RIB STRAP

CROSS-REFERENCE TO RELATED APPLICATION

The present application claims priority to U.S. Provisional Application Ser. No. 62/116,045, entitled "Rib Strap", filed Feb. 13, 2015, the entire disclosure of which is hereby incorporated by reference.

BACKGROUND OF THE INVENTION

Field of the Invention

The present invention relates, in general, to a mine rib support and, in particular, a rib strap for supporting a rib in an underground mine opening.

Description of Related Art

Mine supports are used to reinforce unsupported rock formations adjacent to a mine opening. In particular, the roof and rib of a mine may be supported with bolts inserted into bore holes drilled in the roof or rib that reinforce the unsupported rock formation. The mine roof bolt may be anchored mechanically to the rock formation by engagement of an expansion assembly on the distal end of the mine roof bolt with the rock formation. Alternatively, the mine roof bolt may be adhesively bonded to the rock formation with a resin bonding material inserted into the bore hole. A combination of mechanical anchoring and resin bonding may also be employed by using both an expansion assembly and resin bonding material. The bolts may be utilized in connection with plates or angled supports. Additional or alternative support structures are also utilized including mesh, truss systems, steel set systems, props, etc. depending on the area of the mine and the design requirements.

In certain applications, the roof and rib support structure are designed to be used in the longwall ribs and to be mined with the coal or other resource by the longwall shearer. Accordingly, such rib supports need to be capable of being cut and processed by the mining equipment and also need to have a specific gravity greater than 1.7 to allow the support to sink during the coal preparation floatation process. One conventional arrangement utilizes fiberglass rib pans along with fiberglass bolts. However, the installation of such rib pans and bolts can be difficult due to an uneven rib surface and the angle required for installing the bolt.

SUMMARY OF THE INVENTION

In one aspect, a mine rib support includes at least one elongate member having a first end and a second end, and a center plate defining a first opening and an installation opening, with the first opening receiving a portion of the at least one elongate member. The installation opening is configured to receive a mine bolt.

A first end plate may define an opening that receives the first end of the at least one elongate member and a second end plate defining an opening that receives the second end of the at least one elongate member. The first end plate, the second end plate, and the center plate may each define a planar surface configured to abut a surface of an underground mine opening The first end plate and the second end plate may each include a plurality of splines extending radially inward into the respective openings of the first and second end plates. The first opening of the center plate may be about perpendicular to the installation opening of the center plate. The body of the center plate may define a plurality of openings arranged in a grid pattern. The center plate may include at least one rib extending about perpendicular to the at least one elongate member. The at least one elongate member and the center plate may be configured to be cut by mine processing equipment. The at least one elongate member and the center plate may each have a specific gravity greater than 1.68.

In a further aspect, a mine rib support includes first and second elongate members each having a first end and a second end, and a center plate having a body, with the body defining a first opening that receives the first elongate member, a second opening that receives the second elongate member, and an installation opening configured to receive a mine bolt. The mine rib support also includes a first end plate defining first and second openings for receiving the first end of the first and second elongate members, respectively, and a second end plate defining first and second openings for receiving the second end of the first and second elongate members, respectively.

The first end plate, the second end plate, and the center plate may each define a planar surface configured to abut a surface of an underground mine opening. The first and second openings of the center plate may be about perpendicular to the installation opening of the center plate. The body of the center plate may define a plurality of openings arranged in a grid pattern. The center plate may include a pair of ribs extending between the first and second openings of the center plate. The first and second elongate members, the center plate, and the first and second end plates may be configured to be cut by mine processing equipment. The first and second elongate members, the center plate, and the first and second end plates may each have a specific gravity greater than 1.68. The first end plate and the second end plate may each include a plurality of splines extending radially inward into the respective openings of the first and second end plates.

In another aspect, a method of supporting a mine rib includes: positioning a rib strap against a surface in an underground mine opening, where the rib strap includes at least one elongate member having a first end and a second end, and a center plate defining a first opening and an installation opening, and where the first opening receives a portion of the at least one elongate member, and installing a mine bolt through the installation opening and into the surface in the underground mine opening.

The rib strap may be positioned against a rib including a main seam portion and a rider seam portion, with the at least one elongate member extending from the main seam portion to the rider seam portion, and the center plate positioned against the main seam portion. The method may further include: engaging the main seam portion with a first end plate positioned on the first end of the at least one elongate member, and engaging the rider seam portion with a second end plate positioned on the second end of the at least one elongate member.

DETAILED DESCRIPTION

Figure 1:
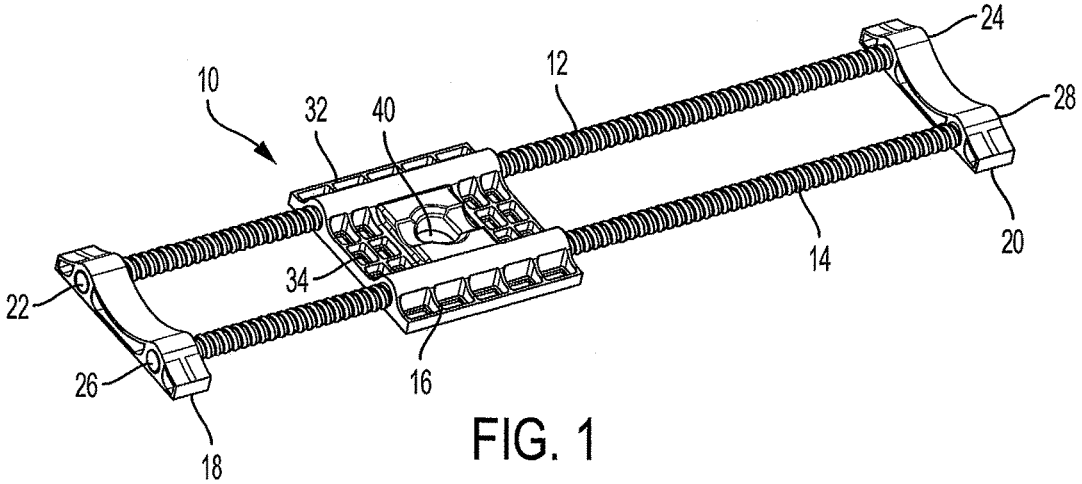
FIG. 1 is a perspective view of a rib strap according to one aspect of the present invention.
Figure 2:
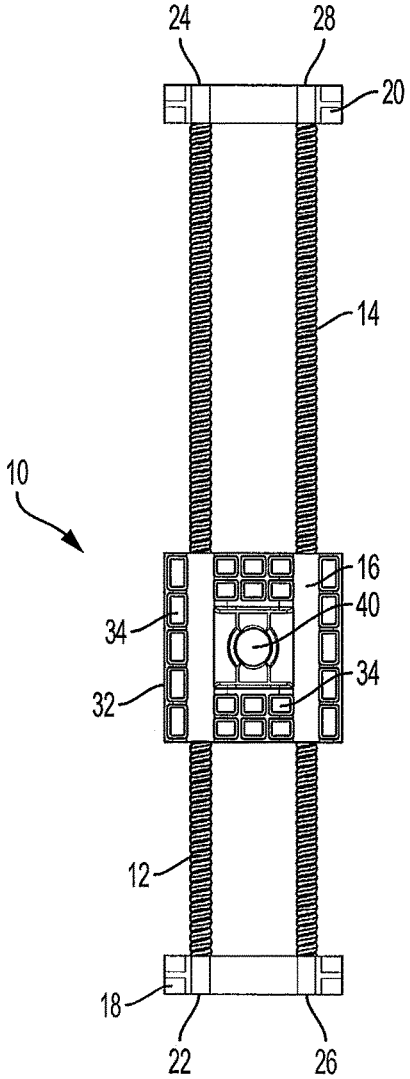
FIG. 2 is a front view of the rib strap of FIG. 1.
Figure 3:
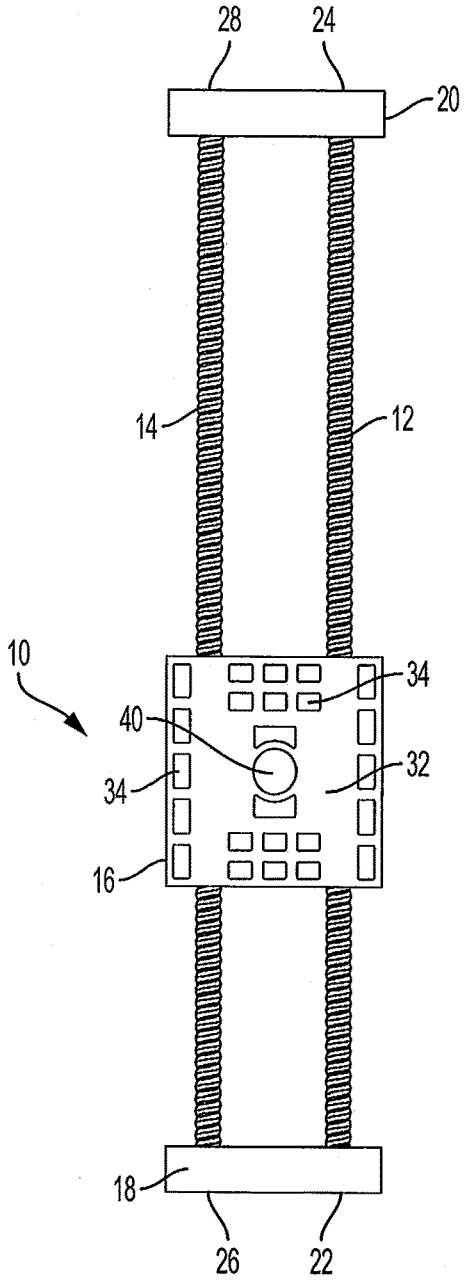
FIG. 3 is a rear view of the rib strap of FIG. 1.
Figure 4:
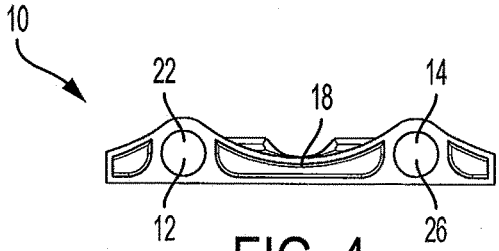
FIG. 4 is a bottom view of the rib strap of FIG. 1.
Figure 5:
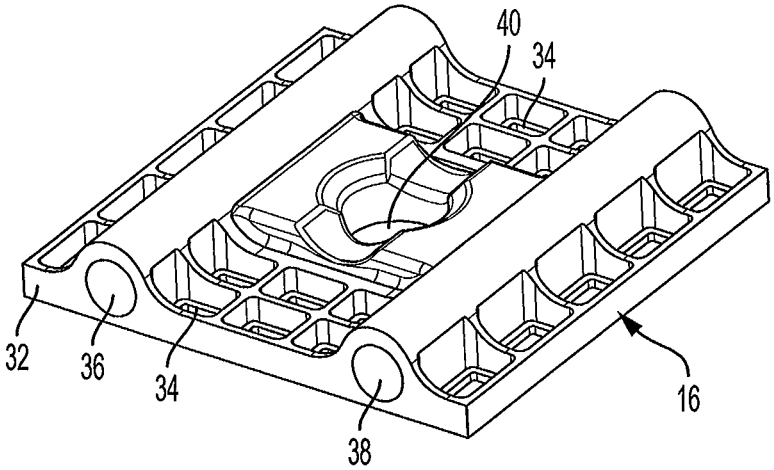
FIG. 5 is a perspective view of a center plate of the rib strap of FIG. 1 according to one aspect of the present invention.
Figure 6:
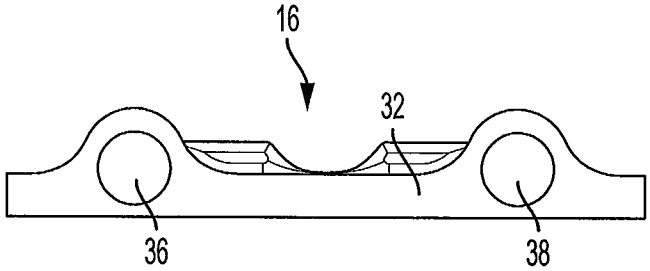
FIG. 6 is a bottom view of the center plate of FIG. 5.
Figure 7:
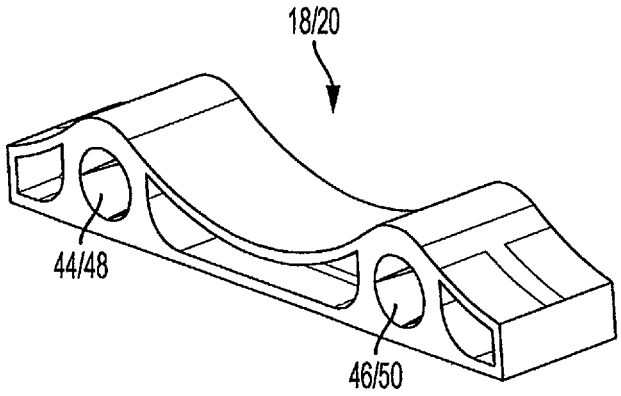
FIG. 7 is a perspective view of an end plate of the rib strap of FIG. 1 according to one aspect of the present invention.
Figure 8:
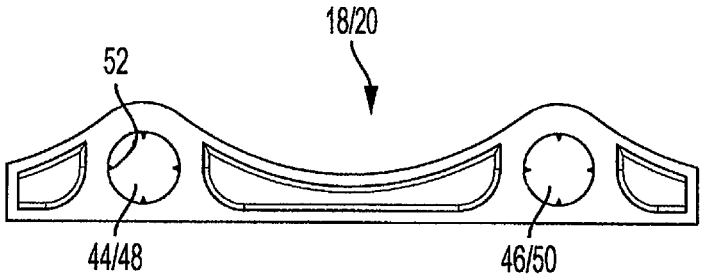
FIG. 8 is a bottom view of the end plate of FIG. 7.
Figure 9:
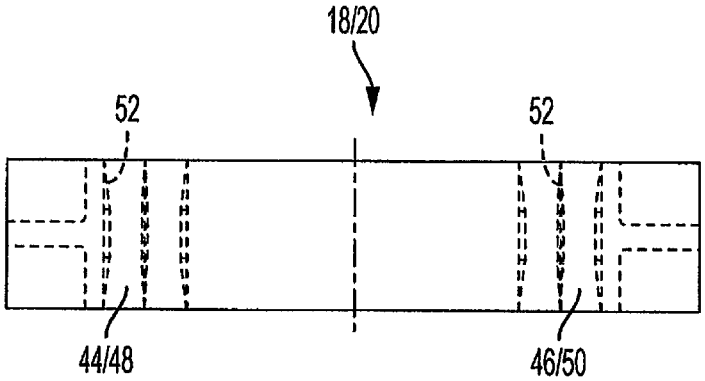
FIG. 9 is a front view of the end plate of FIG. 7.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the embodiments disclosed herein are not to be considered as limiting.

Referring to FIGS. 1-10, a rib strap 10, according to one aspect of the present invention, includes first and second elongate members 12, 14, a center plate 16, and first and second end plates 18, 20. The first and second elongate members 12, 14 each having a first end 22, 26 and a second end 24, 28. The first and second elongate members 12, 14 may be mine bolts made of fiberglass reinforced polymer (FRP), such as the FIREP® FRP bolt commercially available from JENNMAR. The first and second elongate members 12, 14 are cuttable and configured to be processed during excavation of coal. The center plate 16 has a body 32 that defines a plurality of openings 34 arranged in a grid pattern. The plurality of openings 34 of the center plate 16 are configured to provide a gripping surface to engage a rib in an underground mine opening so that the center plate 16 does not move around during installation of the rib strap 10, which is discussed in more detail below.

The body 32 of the center plate 16 also defines a first opening 36 that receives the first elongate member 12 and a second opening 38 that receives the second elongate member 14. The body 32 of the center plate 16 also defines an installation opening 40 that is configured to receive a mine bolt. The installation opening 40 extends in a direction that is about perpendicular to the first and second openings 36, 38 of the center plate 16. The first and second openings 36, 38 of the center plate 16 extend along a longitudinal axis of the center plate 16 and the installation opening 40 extends transversely to the longitudinal axis of the center plate 16, although other suitable orientations and directions may be utilized. The center plate 16 may be moveable relative to the first and second elongate members 12, 14 to adjust the position of the center plate 16 during installation, although the center plate 16 may also be fixed relative first and second elongate members 12, 14. The center plate 16 may be made from a non-metallic material, such as glass reinforced nylon, and is configured to be cuttable and processed during excavation of coal. In particular, the center plate 16 may be made from 66% glass reinforced nylon, although other suitable materials may be utilized.

Referring again to FIGS. 1-10, the first end plate 18 defines first and second openings 44, 46 that receive the first ends 22, 26 of the first and second elongate members 12, 14, respectively. The second end plate 20 defines first and second openings 48, 50 that receive the second ends 24, 28 of the first and second elongate members 12, 14, respectively. The first and second end plates 18, 20 may be made from a non-metallic material, such as glass reinforced nylon, and are configured to be cuttable and processed during excavation of coal. In particular, the first and second end plates 18, 20 may be made from 66% glass reinforced nylon, although other suitable materials may be utilized. The first and second end plates 18, 20 may each include a plurality of splines 52 extending radially inward in each of the first and second openings 44, 46, 48, 50 of the first and second plates 18, 20. The plurality of splines 52 engage the first and second elongate members 12, 14 to secure the first and second end plates 18, 20 to the first and second elongate members 12, 14. The first and second end plates 18, 20 may be generally rectangular with a curved upper surface, although any other suitable shape and configuration may be utilized.

Figure 10:
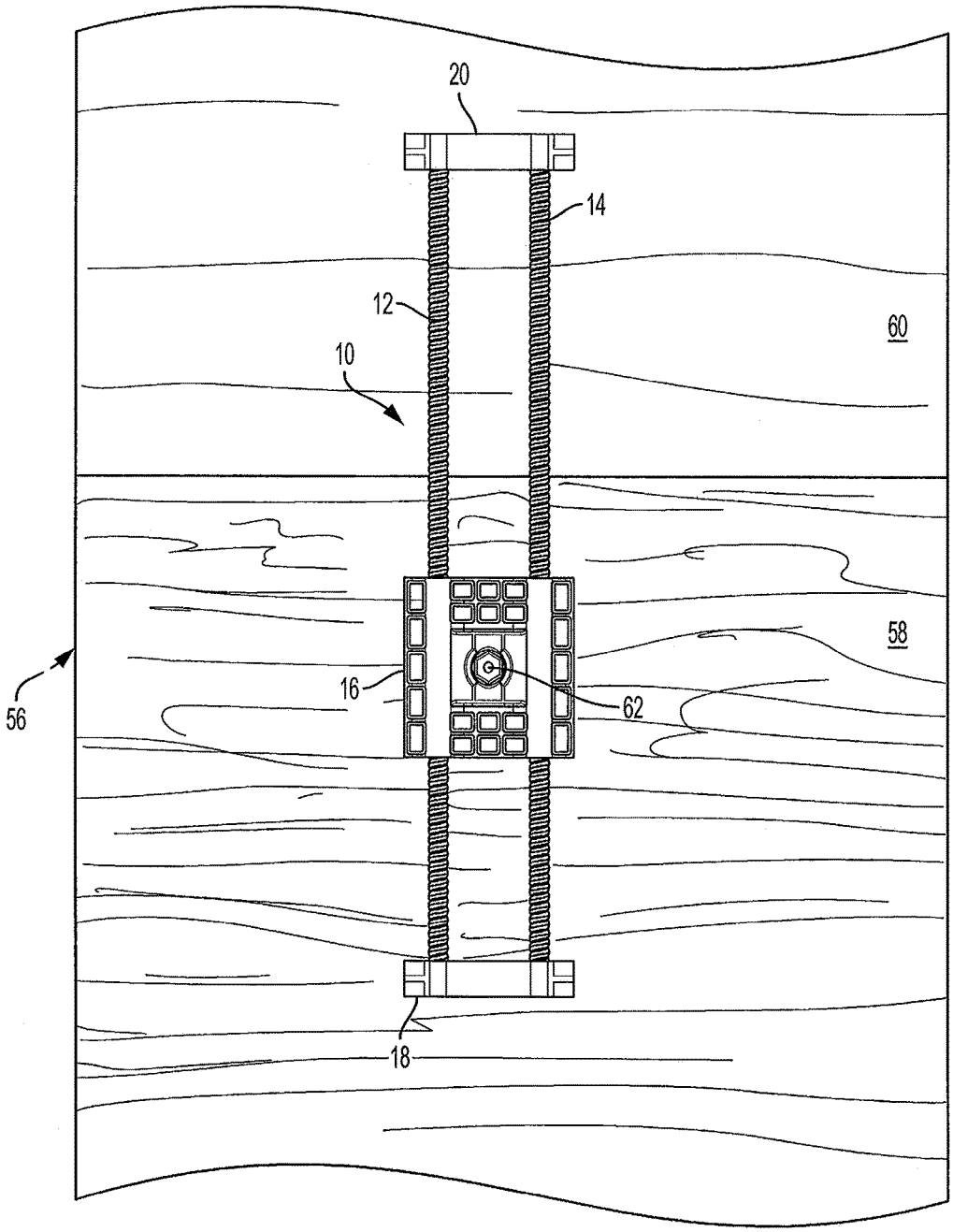
FIG. 10 is a front view of the rib strap of FIG. 1, showing the rib strap supporting a mine rib according to one aspect of the present invention.

Referring to FIG. 10, the rib strap 10 is installed by positioning the rib strap 10 against a surface in an underground mine opening. As shown in FIG. 10, the rib strap 10 is positioned against a rib 56 having a main seam portion 60 and a rider seam portion 62. A mine bolt 62, such as a mine roof bolt made from FRP, is installed through the installation opening 40 of the center plate 16 and into the surface or rib 56 in the underground mine opening. The mine bolt 62 may be the FIREP® FRP bolt commercially available from JENNMAR, although other suitable bolts may be utilized. The mine bolt 62 may be installed using a bolting machine (not shown) that initially drills a borehole and then inserts the mine bolt 62 through the installation opening 40 and into the borehole. The mine bolt 62 may be anchored using conventional anchoring arrangements, such as a mechanical anchor, resin, and/or cementitious grouting. As shown in FIG. 10, the first and second elongate members 12, 14 extend from the main seam portion 58 to the rider seam portion 60 with the center plate 16 being positioned against the main seam portion 58. The first end plate 18 engages the main seam portion 58 and the second end plate 20 engages the rider seam portion 60. The mine bolt 62 is installed into the main seam portion 58. The rib strap 10 only requires the use of a single mine bolt to install the rib strap 10, which beneficially shortens the time for supporting the rib 56 compared to conventional techniques using multiple bolts and multiple plates or pans. Further, the rib strap 10 allows the mine bolt 62 for installation of the rib strap 10 to be positioned lower on the rib 56 and in a direction about perpendicular to the surface of the rib 56, which eliminates the difficult installation of bolts at awkward angles and higher up on the rib 56.

Although the rib strap 10 is shown in connection with the support of a rib 56, the rib strap 10 also could be utilized to support a mine roof. The rib strap 10 may be 48" in length, although other suitable lengths may be utilized. As noted above, the rib strap 10 is configured to be cuttable and processed during excavation of the rib 56. Further, the first and second elongate members 12, 14, the center plate 16, and the first and second end plates 18, 20 may have a specific gravity of 1.68 or greater so that the rib strap 10 sinks during the coal preparation process after excavation of the rib 56 and rib strap 10. Although not shown, the rib strap 10 may not include the first and second end plates 18, 20.

Figure 11:
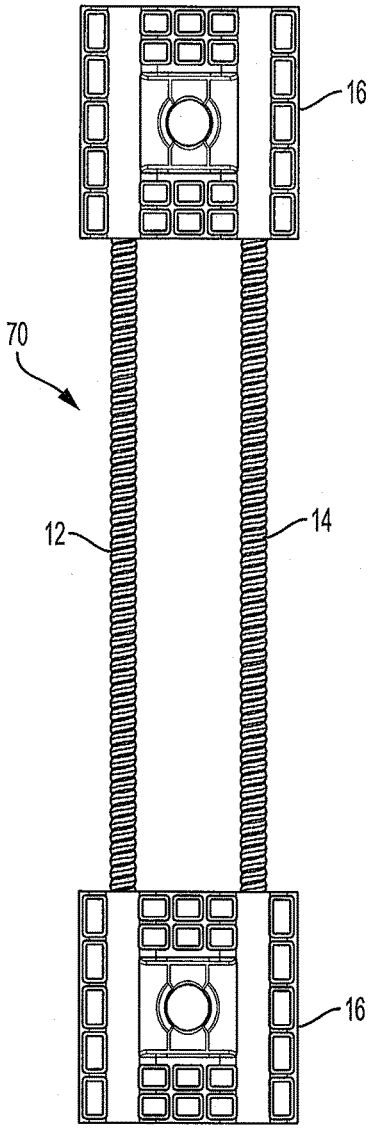
FIG. 11 is a front view of a rib strap according to a second aspect of the present invention.

Referring to FIG. 11, a rib strap 70, according to a second aspect of the present invention, only includes the first and second elongate members 12, 14 with two center plates 16. The rib strap 70 shown in FIG. 11 is installed using first and second mine bolts (not shown) in a similar manner as the rib strap 10 shown in FIGS. 1-10.

Figure 12:
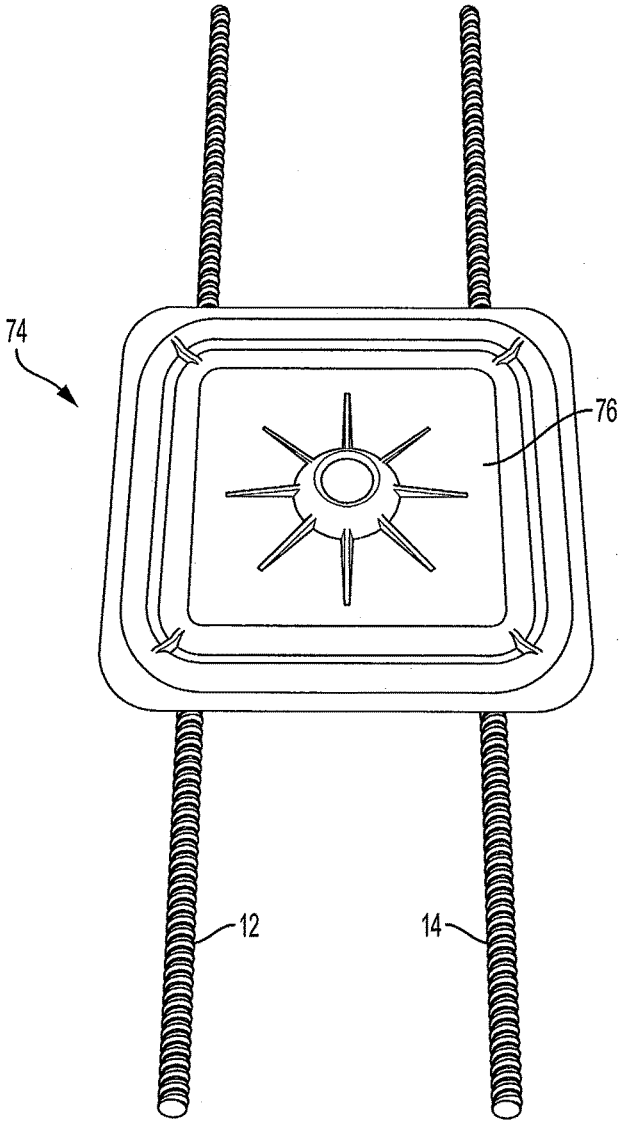
FIG. 12 is a front view of a rib strap according to a third aspect of the present invention.

Referring to FIG. 12, a rib strap 74, according to a third aspect of the present invention, includes the first and second elongate members 12, 14 with a convention fiberglass pan 76 secured to the first and second elongate members 12, 14. The first and second elongate members 12, 14 may be spaced 11" from each other, although other suitable distances may be utilized. The rib strap 74 shown in FIG. 12 may be installed by installing a mine bolt (not shown) through an opening in the pan 76.

Figure 13:
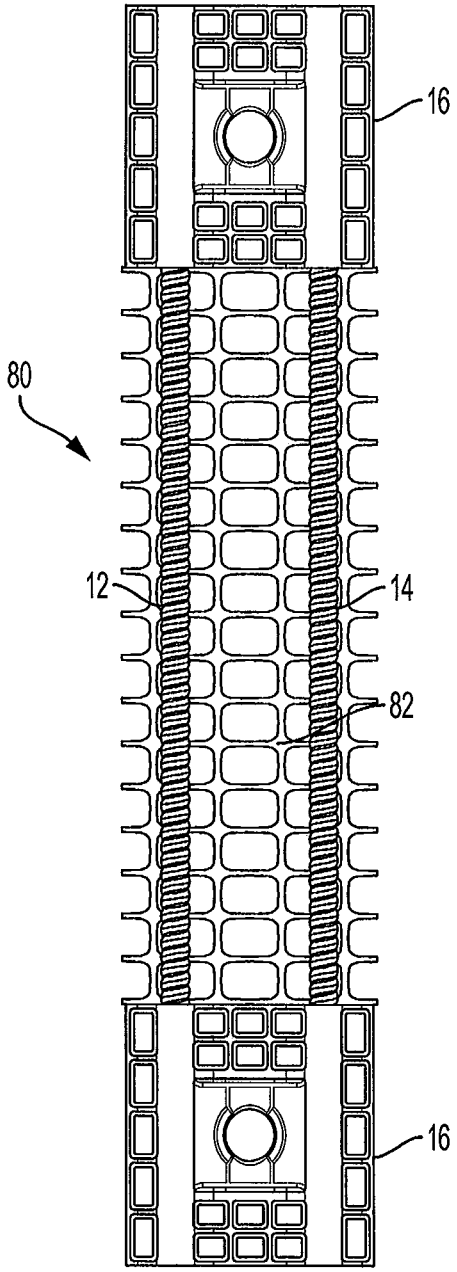
FIG. 13 is a front view of a rib strap according to a fourth aspect of the present invention.

Referring to FIG. 13, a rib strap 80, according to a fourth aspect of the present invention, includes the first and second elongate members 12, 14 with two center plates 16. The rib strap 80 shown in FIG. 13 also includes a section of rib mesh 82 that is secured to the first and second elongate members 12, 14 and/or the center plates 16. The mesh 82 may be 7.5"×48", although other suitable sizes may be utilized.

Figure 14:
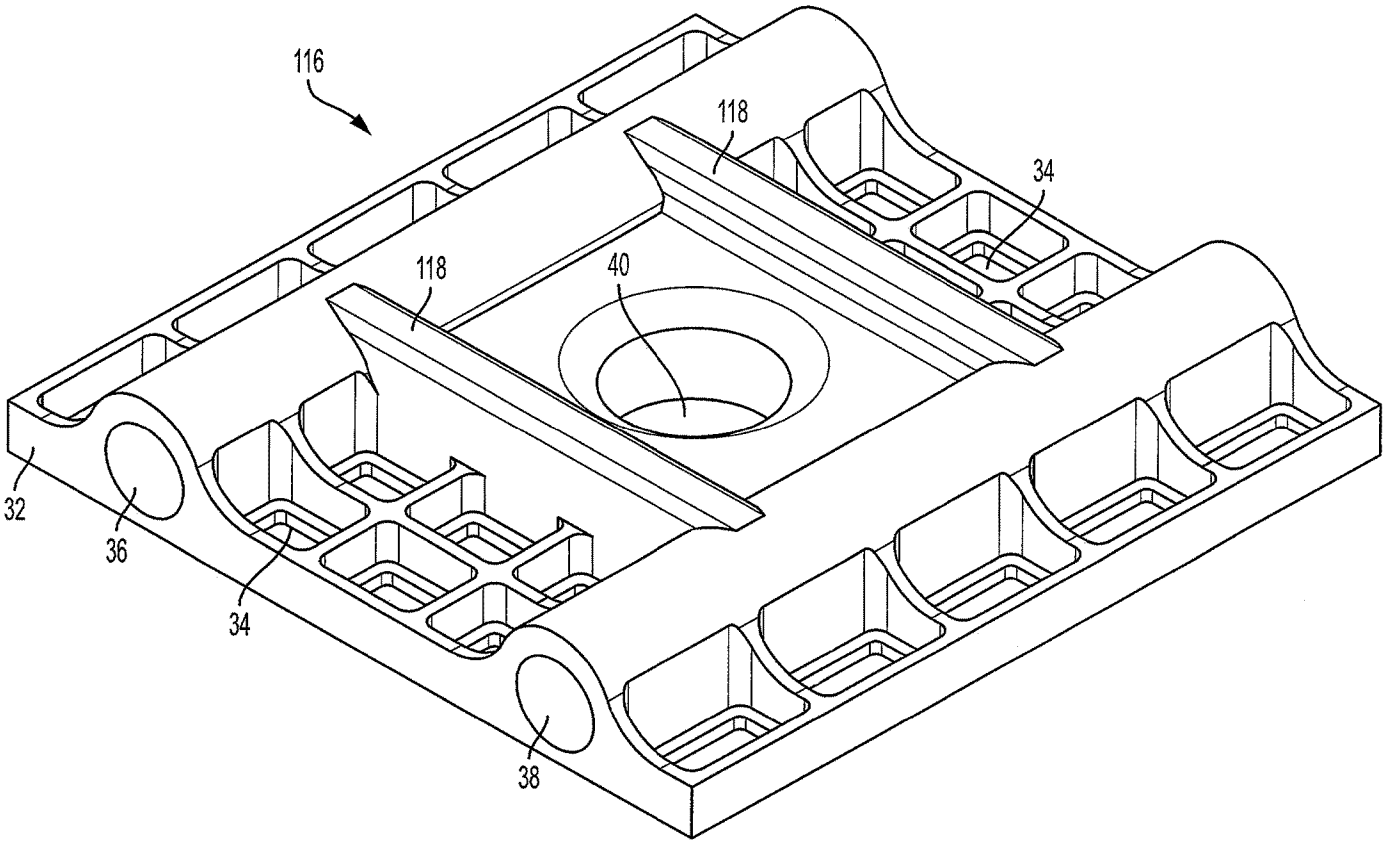
FIG. 14 is a perspective view of a center plate according to a further aspect of the present invention.

Referring to FIG. 14, a center plate 116 according to a further aspect of the present invention is shown. The center plate 116 is similar to the center plate 16 shown in FIG. 5, but includes a pair of ribs 118. The ribs 118 extend transversely between the first and second openings 36, 38 and are spaced apart from each other. The ribs 118 are positioned on either side of the installation opening 40. The ribs 118 are configured to increase the strength of the center plate 116.

While various aspects of the system were provided in the foregoing description, those skilled in the art may make modifications and alterations to these aspects or aspects without departing from the scope and spirit of the invention. For example, it is to be understood that this disclosure contemplates that, to the extent possible, one or more features of any aspect or aspect can be combined with one or more features of any other aspect or aspect. Accordingly, the foregoing description is intended to be illustrative rather than restrictive.

The invention claimed is:

1. A mine rib support comprising:

first and second elongate members each having a first end and a second end;

a center plate having a body, the body defining a first opening that receives the first elongate member, a second opening that receives the second elongate member, and an installation opening configured to receive a mine bolt, the center plate positioned intermediate the first and second ends of the first and second elongate members;

a first end plate defining first and second openings for receiving the first end of the first and second elongate members, respectively, the first end plate secured to the first and second elongate members; and a second end plate defining first and second openings for receiving the second end of the first and second elongate members, respectively, the second end plate secured to the first and second elongate members, wherein a portion of the first and second openings of the first end plate and the second end plate each narrows in diameter to define a narrowed portion, the narrowed portions of the first and second end plates crimping the first end second elongate members to secure the first and second end plates to the first and second elongate members wherein each of the first and second openings have a first end and a second end positioned opposite the first end, the narrowed portions of the first and second end plates each extend from the first end to the second end of the first and second openings, the narrowed portions of the first and second end plates each increasing in size in a radially inward direction from the first and second ends of the first and second openings to a position intermediate the first and second ends of the first and second openings.

2. The mine rib support of claim 1, wherein the first end plate, the second end plate, and the center plate each define a planar surface configured to abut a surface of an underground mine opening.

3. The mine rib support of claim 1, wherein the first and second openings of the center plate are about perpendicular to the installation opening of the center plate.

4. The mine rib support of claim 1, wherein the body of the center plate defines a plurality of grid openings arranged in a grid pattern.

5. The mine rib support of claim 1, wherein the center plate includes a pair of support ribs extending between the first and second openings of the center plate.

6. The mine rib support of claim 1, wherein the first and second elongate members, the center plate, and the first and second end plates are configured to be cut by mine processing equipment.

7. The mine rib support of claim 6, wherein the first and second elongate members, the center plate, and the first and second end plates each have a specific gravity greater than 1.68.

* * * * *